United States Patent [19]

Chaplin et al.

[11] 4,247,248

[45] Jan. 27, 1981

[54] OUTER AIR SEAL SUPPORT STRUCTURE FOR GAS TURBINE ENGINE

[75] Inventors: Gary F. Chaplin; Francis L. DeTolla, both of Vernon; James G. Griffin, West Hartford, all of Conn.

[73] Assignee: United Technologies Corporation, Hartford, Conn.

[21] Appl. No.: 971,289

[22] Filed: Dec. 20, 1978

[51] Int. Cl.³ ..... F01D 25/28

[52] U.S. Cl. ..... 415/136

[58] Field of Search ..... 415/134, 135, 136, 138, 415/115, 116; 60/39.66, 39.75

[56] References Cited

U.S. PATENT DOCUMENTS

| | | | |
|---|---|---|---|
| 1,211,682 | 1/1917 | Curtis . | |
| 1,358,824 | 6/1971 | Smuland et al. | |
| 2,823,890 | 2/1958 | Oeschslin . | |
| 2,919,104 | 11/1959 | Blyth . | |
| 3,067,983 | 12/1962 | Koziura | 415/138 |
| 3,262,677 | 7/1966 | Bobo et al. | |
| 3,391,904 | 7/1968 | Albert et al. | |
| 3,443,791 | 5/1969 | Sevetz et al. | 415/115 |
| 3,730,640 | 5/1973 | Rice et al. | |
| 3,841,787 | 10/1974 | Scalzo . | |
| 3,860,358 | 1/1975 | Cavicchi et al. | |
| 3,892,497 | 7/1975 | Gunderlock et al. | 415/138 |
| 3,975,114 | 8/1976 | Kalkbrenner | 415/138 |
| 3,980,411 | 9/1976 | Crow | 415/115 |
| 4,005,946 | 2/1977 | Brown et al. | |
| 4,013,376 | 3/1977 | Bisson et al. | |
| 4,019,320 | 4/1977 | Redinger et al. | 60/39.66 |
| 4,053,254 | 10/1977 | Chaplin et al. | |

*Primary Examiner*—Robert E. Garrett

*Attorney, Agent, or Firm*—Gene D. Fleischhauer

[57] ABSTRACT

A support structure for an outer air seal of a gas turbine engine is disclosed. Various construction details which improve the sealing effectiveness of the outer air seal are developed. The outer air seal is held in close proximity to the rotor blades by the circumferentially adjacent support segments.

9 Claims, 8 Drawing Figures

OUTER AIR SEAL SUPPORT STRUCTURE FOR GAS TURBINE ENGINE

BACKGROUND OF THE INVENTION

1. Field of the Invention

This invention relates to gas turbine engines and more particularly to the structure supporting an outer air seal about an array of rotor blades in such an engine.

2. Description of the Prior Art

A gas turbine engine has a fan section, a compression section, a combustion section, and a turbine section. A rotor extends axially through the turbine section. A row of rotor blades extend outwardly from the rotor. A stator circumscribes the rotor. The stator includes an engine case and an outer air seal supported and positioned by the case. The outer air seal is radially spaced from the row of rotor blades leaving a tip clearance therebetween. Working medium gases are pressurized by a fan section, compressed in the compressor section, burned with fuel in the combustion section and expanded in the turbine section. The temperatures of the working medium gases discharging from the combustion section into the turbine often exceed fourteen hundred degrees Celsius (1400° C.).

The hot gases entering the turbine section lose heat to the turbine blades and the case. The turbine blades are in close proximity to the hot gases and respond rapidly to temperature fluctuations of the gases. The outer case is remotely located with respect to the hot gases and responds more slowly to temperature fluctuations than do the rotor blades. The outer air seal is positioned by the case and responds with the case. Accordingly, the tip clearance between the outer air seal and the row of rotor blades varies during transient operating conditions. A substantial initial clearance is provided between the outer air seal and the blade tips to prevent destructive interference. Resultantly, the clearance at equilibrium conditions is larger than desired and a portion of the working medium gases leaks over the tips of the blades. Such leakage of medium over the blade tips limits the obtainable stage efficiency and engine performance.

In modern engines, the tip clearance between the rotor blades and the outer air seal is reduced by cooling a portion of an engine case. A cooling medium, such as air pressurized by an upstream compression stage, is typically used for the cooling. U.S. Pat. No. 4,019,320 to Redinger et al. entitled "External Gas Turbine Engine Cooling For Clearance Control" is representative of structures in which the diameter of an outer air seal is reduced by cooling a portion of the case. As shown in Redinger et al., the engine case has massive external flanges and large internal rings. The large internal rings support the outer air seal. These continuous rings are flanges extending inwardly from the engine case and are support rings rigidly bolted to the inwardly extending flanges. As the cooling medium carries heat away from the external flanges, the external flanges contract and force the internal rings and the outer air seal to a smaller diameter. The tip clearance decreases and increased turbine efficiency results.

Athough increased turbine efficiency results in increased performance, the increase in performance is diminished by the use of cooling air. To pressurize the cooling air, the gas turbine engine uses energy; energy that otherwise might be used for propulsion. Any reduction in cooling air consumption reduces the performance penalty caused by the work of pressurization. A support structure having a fast response time enables the turbine to reach quickly the desired level of turbine efficiency. A faster response time causes a faster decrease in the tip clearance. An improved support structure having a fast response time and requiring smaller amounts of cooling air to obtain a given outer air seal displacement is needed. Such an improved support structure increases the sealing effectiveness of the outer air seal. A more effective outer air seal results in a more efficient machine. The need to produce energy efficient machines has grown in recent years because of increased fuel costs and limited fuel supplies. Accordingly, scientists and engineers are working to design a support structure for use in externally cooled turbine sections that will increase the sealing effectiveness of the outer air seal.

SUMMARY OF THE INVENTION

A primary object of the present invention is to increase the sealing effectiveness of an outer air seal which circumscribes an array of turbine blades in an axial flow rotary machine. Other objects are to support the outer air seal from an engine case and to control the diameter of the outer air seal by selectively expanding or contracting the outer case. A further object is to minimize the effect of an internal support structure on the thermal response of the case.

According to the present invention, a segmented outer air seal is attached to a coolable engine case by a plurality of circumferentially extending upstream support segments and by a plurality of circumferentially extending downstream support segments.

According to one detailed embodiment each support segment is affixed to the engine case at a single point to enable uninhibited expansions of the engine case.

A primary feature of the present invention is the plurality of support segments which join the outer air seal to the engine case. Another feature is a scalloped flange extending inwardly from the engine case. A dowel bolt through the center of each segment attaches the segment to the scalloped flange. A shear material is disposed between a portion of the support segment and the outer case in at least one detailed embodiment. In another embodiment, a shouldered bolt and a spring washer press each end of the support segment against the scalloped flange.

A principal advantage of the present invention is the sensitivity of the case diameter to changes in case temperature. The retardant effect of the outer air seal and the seal support on thermal response is minimized. Substantial displacement of the outer case and the outer air seal is enabled with limited amounts of cooling air. An adequate fatique life is insured by enabling each support segment to move independently of the adjacent support segments and by attaching each support segment to the scalloped flange at a single point. In at least one embodiment, the effectiveness of the seal against the axial leakage of working medium gases is increased by the spring washers pressing the support segments against the scalloped flange.

The foregoing and other objects, features and advantages of the present invention will become more apparent in the light of the following detailed description of preferred embodiments thereof as discussed and illustrated in the accompanying drawing.

DESCRIPTION OF THE PREFERRED EMBODIMENT

Figure 1:
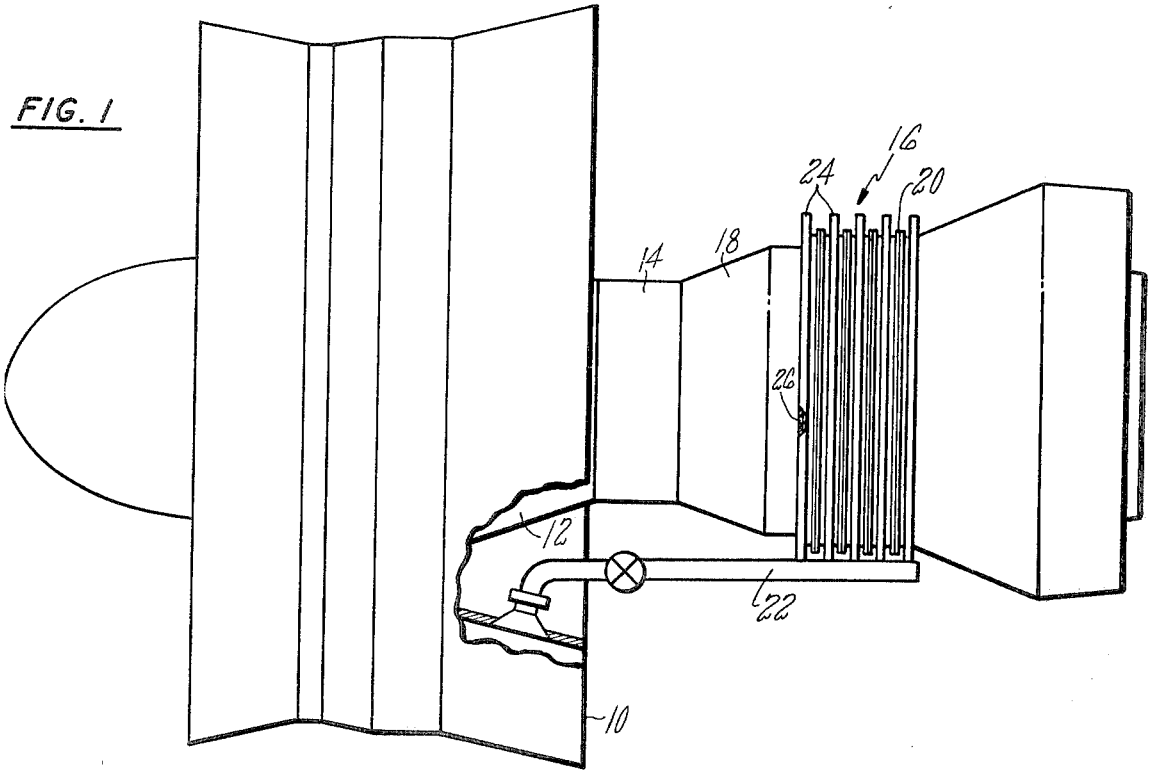
FIG. 1 is a view of a turbofan engine with a portion of a fan case broken away to reveal a cooling air duct.

A turbofan, gas turbine engine embodiment of the invention is illustrated in FIG. 1. Principal sections of the engine include a fan section 10, a compression section 12, a combustion section 14 and a turbine section 16. An engine case 18 circumscribes the compression section, combustion section and turbine section. The case in the area of the turbine section is coolable and has a plurality of external rails 20 extending circumferentially about the case. A duct 22 for cooling air extends rearwardly from the fan section. A plurality of spray bars 24 are connected to the duct and circumscribe the case. The spray bars have a multiplicity of cooling air holes 26 facing the case.

Figure 2:
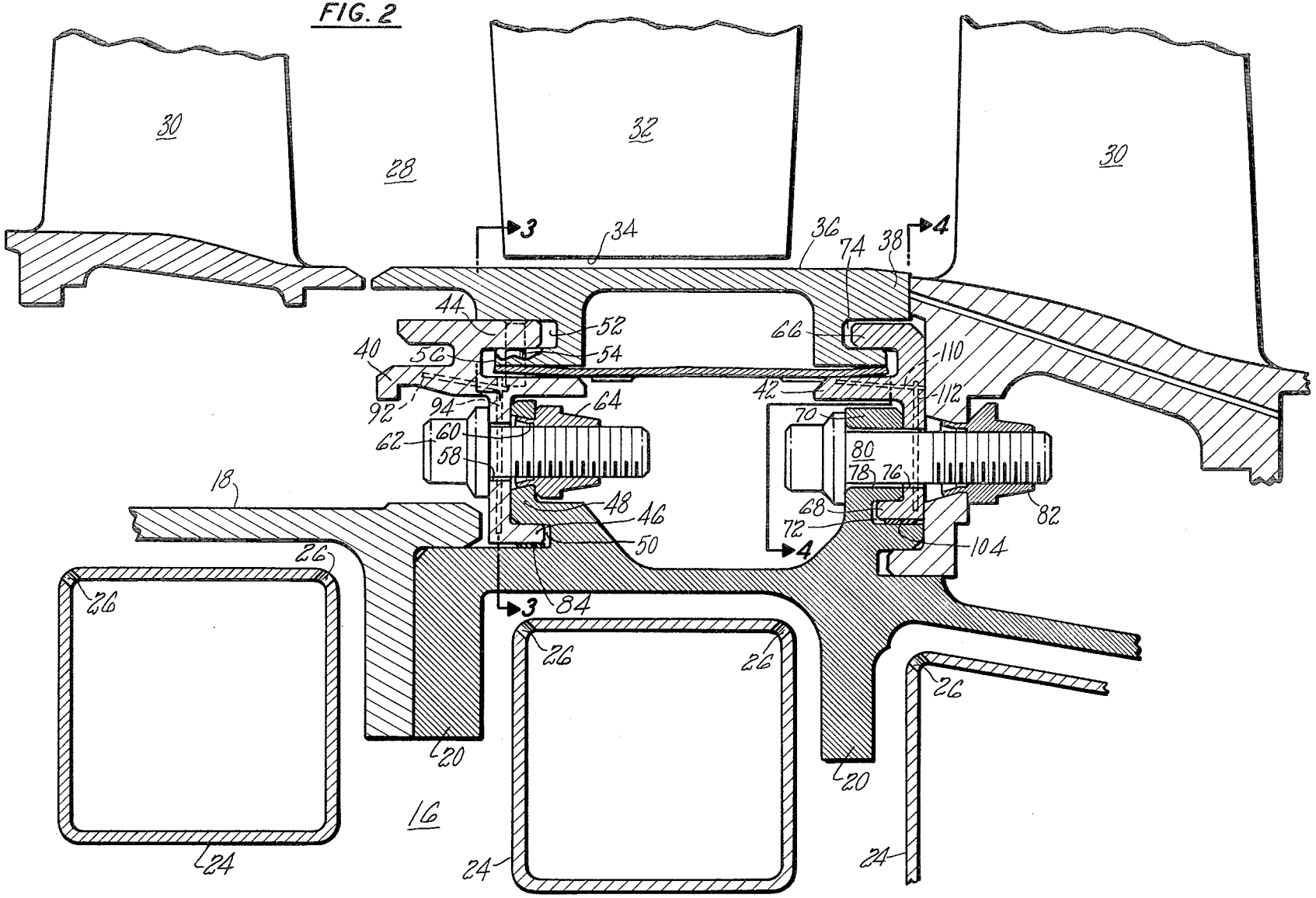
FIG. 2 is a cross section view of a portion of the turbofan engine showing a portion of the engine and an outer air seal.

FIG. 2 illustrates a portion of the turbine section 16 and shows two of the rails 20. An annular flow path 28 for working medium gases extends axially through the turbine section. A plurality of stator vanes 30 extend inwardly across the flow path. A plurality of rotor blades 32 having tips 34 extend outwardly across the flow path. A stator structure as an outer air seal 36 circumscribes the tips of the rotor blades. Means for attaching the outer air seal to the engine case and for adjusting the diameter of the outer air seal such as an upstream support structure and a downstream support structure are shown. The upstream rail 20 is radially outwardly of and in close proximity to the upstream support structure. The downstream rail 20 is radially outwardly of and in close proximity to the downstream support structure. The outer air seal is composed of a plurality of arcuate seal segments, as represented by the single seal element 38. An upstream support ring, such as a plurality of upstream support segments, as represented by the single upstream support segment 40, extend between the case and the seal segments to support the upstream ends of the seal segments. Each upstream support segment has two end portions and a central portion therebetween. A downstream support ring, such as a plurality of downstream support segments, as represented by the single downstream support segment 42, extend between the case and the seal segments to support the downstream ends of the seal segments. Each downstream support segment has two end portions and a central portion therebetween.

Each upstream support segment 40 has an inner tongue 44 and an outer tongue 46. The outer tongue engages the engine case. The engine case has a portion of the upstream support structure such as an upstream internal flange 48 and a groove 50 at the base thereof. The groove extends circumferentially about the case and is adapted to receive the outer tongue 46 of the upstream support segment. The inner tongue 44 of the upstream support segment engages a corresponding seal segment. The seal segment has an upstream groove 52 which is adapted to receive the inner tongue. One or more indexing pins, as represented by the indexing pins 54, extend outwardly from the inner tongue. An indexing slot 56 in each seal segment engages a corresponding indexing pin on the support segment. Each upstream support segment has a dowel hole 58 and the adjacent flange 48 has a dowel hole 60. A shouldered bolt 62, having a dowel-like shank, passes through the hole 58 and the hole 60 to engage a nut 64.

Each downstream support segment 42 has an inner tongue 66 and an outer tongue 68. The outer tongue engages the engine case. The engine case has a portion of the downstream support structure such as a downstream internal flange 70 and a groove 72 at the base thereof. The groove extends circumferentially about the case and is adapted to receive the outer flange tongue 68 of the downstream support segment. The inner tongue 66 of the downstream support segment engages a corresponding seal segment. The seal segment has a downstream groove 74 which is adapted to receive the inner tongue. Each downstream support segment has a dowel hole 76 and the adjacent flange 70 has a dowel hole 78. A shouldered bolt 80 having a dowel like shank passes through the hole 76, the hole 78, and the vane 30 to engage a nut 82.

Figure 3:
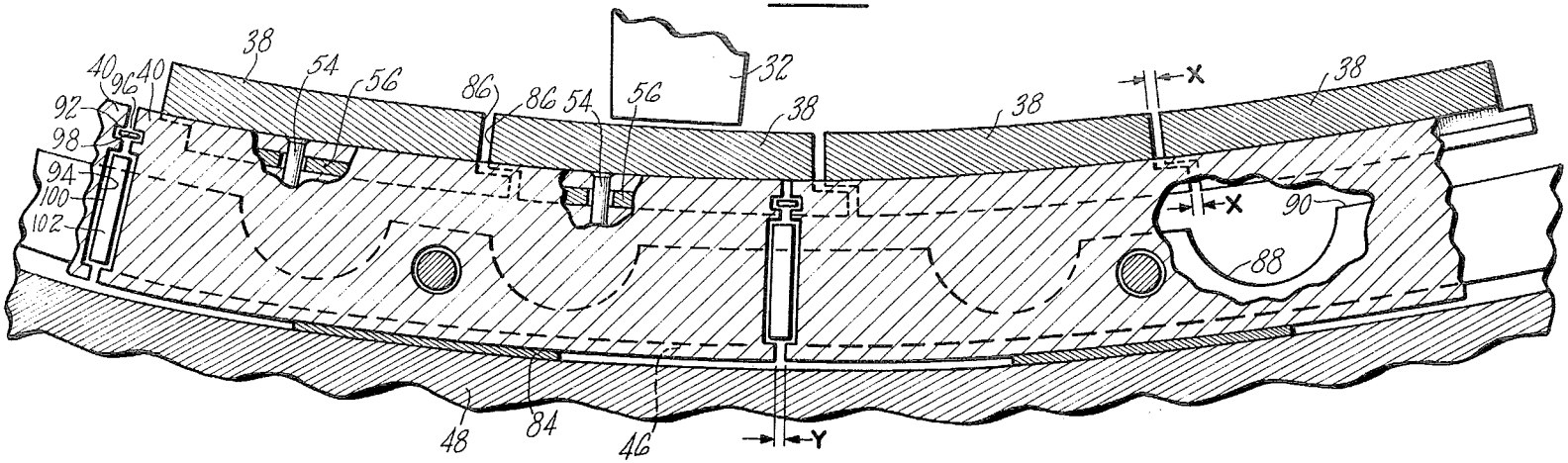
FIG. 3 is a sectional view taken along the line 3—3 as shown in FIG. 2.

As shown in FIG. 3, a shearable material 84, such as nickel graphite, is disposed between the outer tongue 46 of each upstream support segment and the upstream internal flange 48 of the case. Each seal segment 38 has ends 86 which abut the adjacent seal segments. The abutting ends overlap to seal radially between adjacent segments. The seal segments are circumferentially spaced, one from another, leaving a gap X between adjacent seal segments. The upstream support segments are circumferentially spaced, one from another, leaving a gap Y between adjacent support segments. The gap X and the gap Y are never aligned with each other. The upstream flange 48 has a plurality of scallop-like depressions 88 interrupted by circumferentially continuous material such as continuous portions 90. The continuous portion of the flange is always aligned with the gap Y.

Each upstream support segment 40 has an inner groove 92 extending in an axially oriented direction and an outer groove 94 extending in a radially oriented direction. The inner grooves 92 of adjacent support segments form feather seal cavity 96 that is axially oriented. A feather seal 98 is disposed in the cavity 96 and is axially oriented. The outer grooves 94 of adjacent support segments form a feather seal cavity 100 that is radially oriented. A feather seal 102 is disposed in the cavity 100 and is radially oriented.

Figure 4:
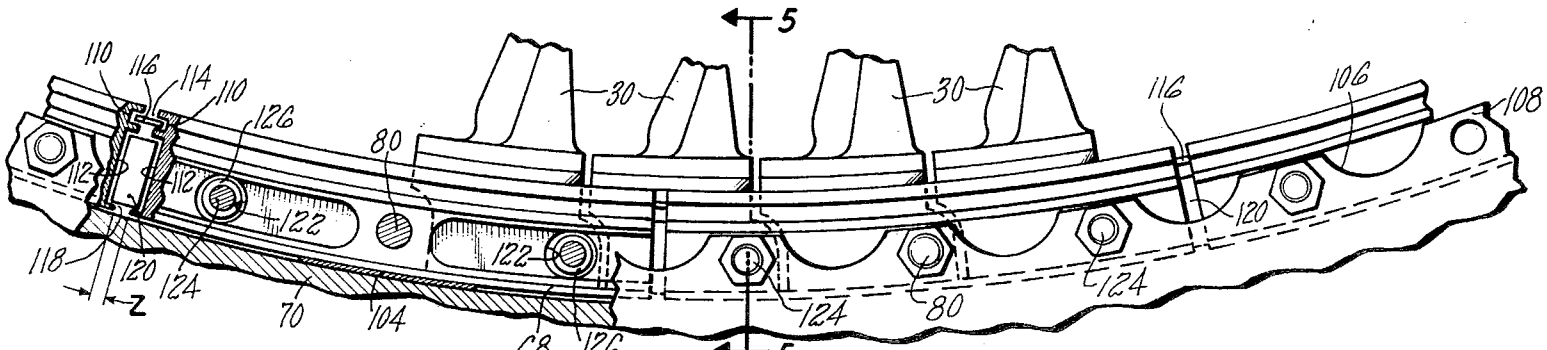
FIG. 4 is a sectional view taken along the line 4—4 as shown in FIG. 2 with portions of the engine case and a downstream internal flange broken away to reveal a downstream support segment.

As shown in FIG. 4, a shearable material 104, such as nickel graphite, is disposed between the outer tongue 68 of each downstream support segment and the downstream internal flange 70 of the case. The downstream support segments are circumferentially spaced, one from another, leaving a gap Z between adjacent support segments. The gap X between adjacent seal segments and the gap Z are never aligned with each other. The downstream flange 70 has a plurality of scallop-like depressions 106 interrupted by circumferentially continuous material such as continuous portions 108.

Each downstream support segment 42 has an inner groove 110 extending in an axially oriented direction and an outer groove 112 extending in a radially oriented direction. The inner grooves 110 of adjacent support segments form a feather seal cavity 114 that is axially oriented. A feather seal 116 is disposed in the cavity 114 and is axially oriented. The outer grooves 112 of adjacent support segments form a feather seal cavity 118 that is radially oriented. A feather seal 120 is disposed in the cavity 118 and is radially oriented.

The ratio of the number of vanes to the number of support segments varies between embodiments. The present embodiment has three vanes 30 for each support segment. One vane 30 is disposed across the gap Z between adjacent downstream support segments. The downstream support segment and one of the vanes 30 are both attached to the downstream flange 70 by the shouldered bolt 80. The downstream support segment has two slots 122 having a substantially cylindrical shape. A shouldered end bolt 124 passes through each slot. The thickness of the support segment in the region of the end bolt is less than the thickness of the support segment in the region of the bolt 80. A spacer 126 is disposed in each slot. The spacer has a thickness equal to or slightly greater than the thickness of the support segment in the region of the bolt 80.

Figure 5:
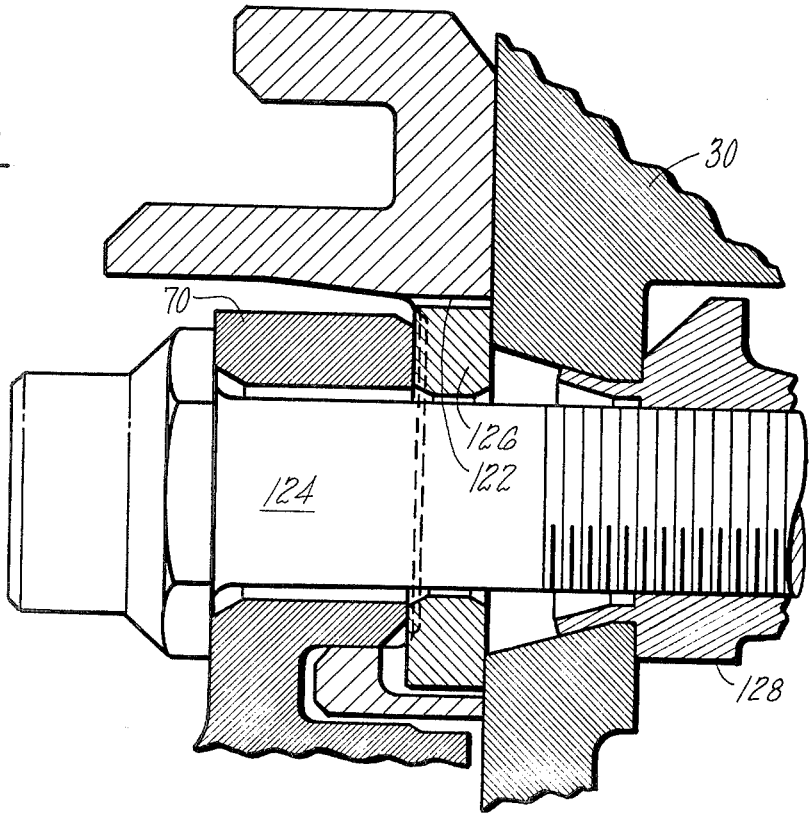
FIG. 5 is a sectional view taken along the line 5—5 as shown in FIG. 4.

As shown in FIG. 5, each end bolt 124, spacer 126, and nut 128 attach a vane 30 to the flange 70. The thickness of the spacer 126 prevents the end bolt and nut from pressing the support segment to the flange 70.

Figure 6:
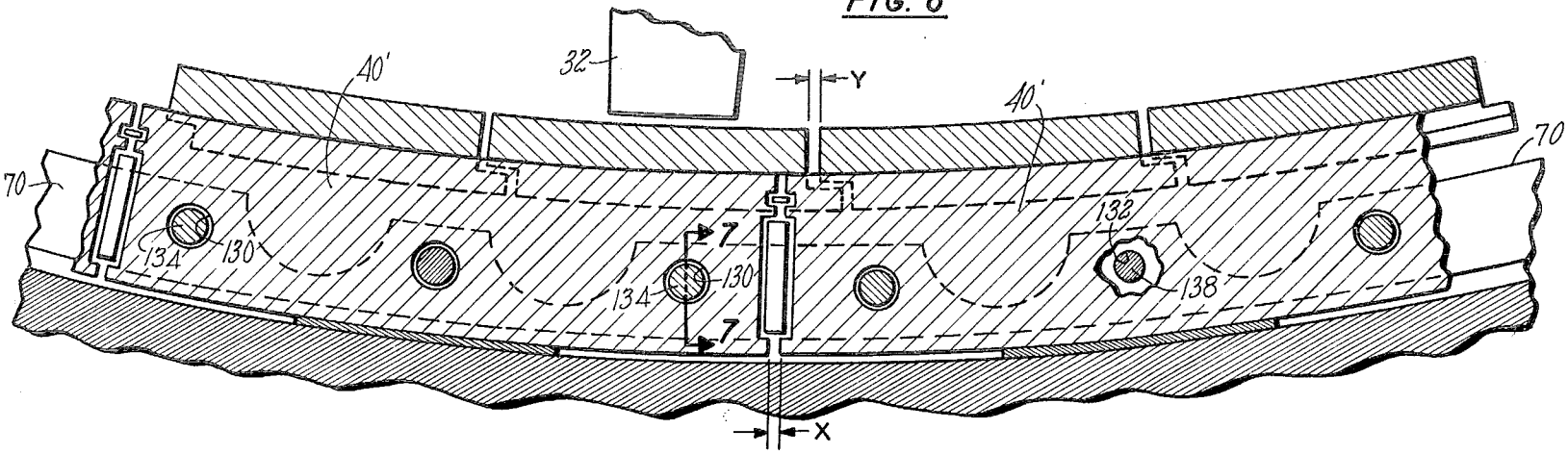
FIG. 6 is a sectional view corresponding to the FIG. 3 view and shows an alternate embodiment.

FIG. 6 shows an alternate embodiment of the invention having a mechanical means for applying a substantially perpendicular force to the upstream support segment. An upstream support segment 40' has two holes 130. The continuous portion of the flange 70 has a plurality of dowel holes 132. A retention means for the means for applying a force, such as a shouldered end bolt 134 passed through the hole 130 and the hole 132.

Figure 7:
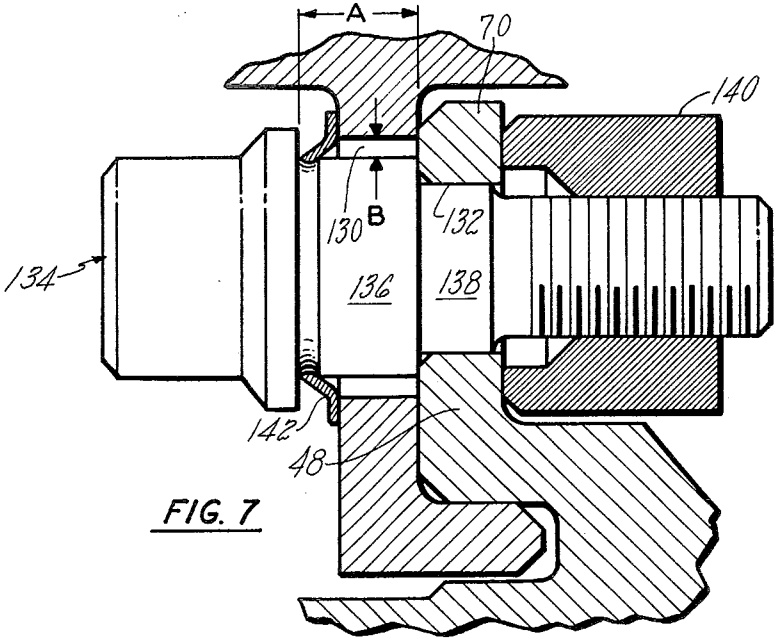
FIG. 7 is a sectional view taken along the line 7—7 as shown in FIG. 6.

As shown in FIG. 7, each of the shouldered end bolts 134 has a first shank portion 136 passing through the upstream support segment 40'. The first shank portion has a length A and a diametrical clearance B. The first shank portion narrows to a second shank portion 138. The second shank portion is dowel-like and passes through the dowel hole 132 in the continuous portion of the flange 48 to engage a nut 140. A means for applying a substantially perpendicular force such as an initially coned (commonly referred to as Belleville) spring 142 is trapped between each shouldered end bolt and the upstream support segment 40'.

Figure 8:
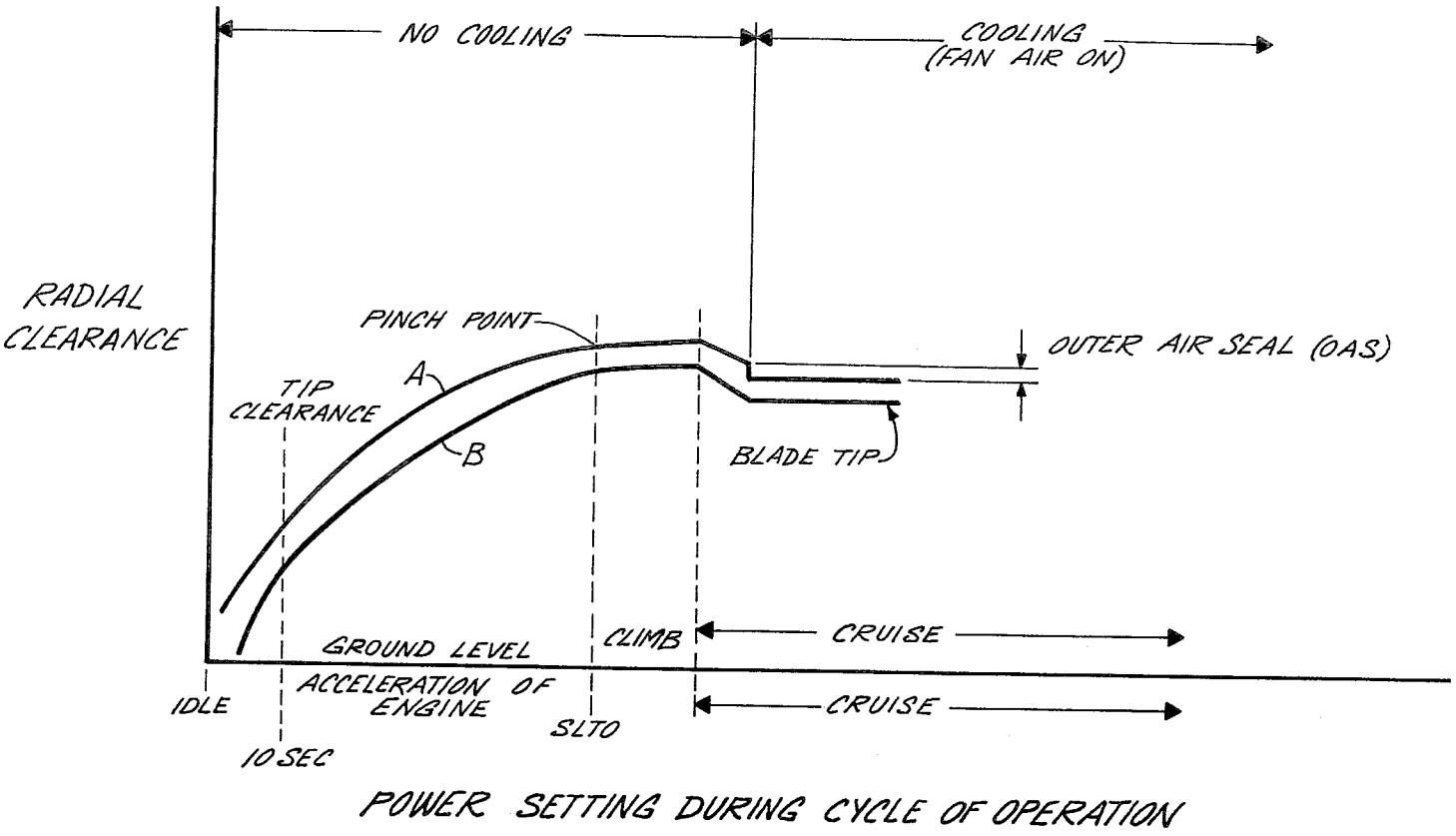
FIG. 8 is a graphical representation showing the radial position of the outer air seal and of the rotor blade tip as a function of the power setting during a typical operating cycle for a turbofan engine.

During operation of the gas turbine engine, hot gases generated in the combustion section 14 flow along the annular flow path 28 into the turbine section 16. As the hot gases lose heat to components in the turbine section, the temperature of each component rises and the components expand thermally. Components, such as the rotor blades 32 and the engine case 18, expand at different rates. FIG. 8 graphs the radial position of the tips of the blades 32 and the radial position of the outer air seal. The radial positions are shown at various power settings within the engine flight cycle. Line A shows the radial position of the outer air seal. Line B shows the corresponding radial position of the tips of the blades.

The closest point of approach of the rotor blades to the outer air seal occurs at maximum power conditions such as Seal Level Takeoff (SLTO) and is referred to as the pinch point. The structure of the present invention enables the clearance at cruise conditions to approximate the clearance at the pinch point.

At SLTO, the gas stream loses heat to the case, the temperature of the case rises, and the case expands thermally. The diameter of the case grows larger and components attached to the case move outwardly. The temperatures of the internal upstream flange 48 and the downstream flange 70 rise faster than does the temperature of the case and the rails 20. The upstream flange and the downstream flange exert a force in the radial direction that is opposed by an equal force from the case and the rails. During engine operation, the radial forces cause cyclic compressive stresses in the flanges and cyclic tensile stresses in the case and rails. The upstream flange has a minimal ability to generate these radial forces because of gaps, such as scallop-like depressions 88 in flange 48 and 106 in flange 70. These gaps interrupt the circumferential continuity of the flange. A concomitant reduction in the hoop strength of the flange occurs. The center bolt 62 affixes the center portion of the upstream support segment 40 to the upstream flange and prevents the center portion of the upstream support segment from shifting in a circumferential direction. Radial movement in the groove 50 of the center portion of the upstream support segment is prevented by the shearable material 84. The center bolt 80 in the downstream support segment 42 prevents the center portion of the downstream support section from shifting circumferentially with respect to the downstream flange. The shearable material 104 prevents radial movement of the downstream support segment in the outer groove 72. The ends of each upstream support segment and each downstream support segment are free to move circumferentially. The slots 122 in each downstream support segment accommodate the end bolts 124 and the spacers 126 and permit the downstream support segment to slide with respect to the flange 70. Because the ends are free to move circumferentially, the segments do not act as a plurality of rigid beams resisting the expansion of the case.

As the engine case moves outwardly, the groove 50 and the groove 72 also move outwardly. The outer tongue 46 near each end of every upstream support segment slides circumferentiallly in the groove 50. The circumferential gap X between each pair of adjacent upstream support segments grows larger. The inner tongue 68 near each end of every downstream support segment slides circumferentially in the groove 72. The circumferential gap Z between each pair of adjacent downstream support segments grows larger.

The individual seal segments 38 move outwardly as the case expands. The inner tongue 44 of the upstream support segments slides with respect to the upstream groove 52 of the seal segment. Similarly, the inner tongue 66 of the downstream support segment slides with respect to the downstream groove 72 of the seal segment. The abutting ends 86 of adjacent seal segments 38 slide away from each other increasing the gap Y therebetween. The outer air seal, composed of the plurality of seal segments 38, increases in circumferential length and in diameter. The clearance between the rotor blade tips and the outer air seal, however, does not increase with movement of the case. The blades during SLTO have moved rapidly outwardly to the maximum radial position of the blades. The case, lagging the blade movement, has not reached the maximum radial position the case will achieve. The clearance between the blades and the outer air seal (tip clearance) is a minimum. The pinch point has been reached and further operation at SLTO causes the case to expand. In a short time, the pinch point is passed.

As the engine progresses in its cycle of operation to a lower power setting, for example, cruise, the temperature of the hot gases entering the turbine decreases and the dynamic forces acting on the rotor blades decrease. As shown in FIG. 8, both the rotor and the turbine blades contract and the tip clearance becomes larger. At this point, cooling air is flowed to the spray bars 24. The air discharges through cooling air holes 26 and impinges on the rails 20 and on the engine case. The air cools the rails causing the rails to contract. The rails squeeze the case inwardly increasing the thermal contraction of the case. The upstream flange 48 and the downstream flange 70 offer minimal resistance to inward movement of the case. The diameter of the case grows smaller. Components attached to the case move inwardly. The bolt 62 in the upstream support segment 40 and the bolt 80 in the downstream support segment 42 prevent the support segments from shifting circumferentially. Radially movement with respect to the groove is prevented by the shearable material 81 and the shearable material 104 disposed between the flange and the case. The ends of each support segment are free to move circumferentially. The ends move circumferentially by sliding in their respective grooves. The circumferential spacing between adjacent support segments grow smaller causing the widths of the circumferential gap X and of the circumferential gap Z to decrease. The support segments move inwardly. As the support segments move inwardly the abutting ends of adjacent seal segments slide toward each other. The outer air seal is carried by the case to a smaller diameter and the clearance between the rotor blade tips and the outer air seal decreases.

The present invention increases the ability of the case to efficiently and quickly position the outer air seal. The case requires less cooling air to position the outer air seal using support segments than would an equivalent case using a plurality of rigid beams or a continuous ring as a support between the case and the outer air seal. Thermal contractions and expansions of the case do not permanently deform downstream and upstream support segments. A thin case wall and the scallop-like depressions in the inner flanges reduce the ability of the inner portion of the wall to resist the inward directed movement of the case.

During expansions and contractions of the outer case the feather seal 98 and the feather seal 102 block the leakage of gases between adjacent upstream support segments. Feather seal 116 and feather seal 120 block such leakage between adjacent downstream support segments. Additional blockage is provided by the alignment of the gap X and the gap Z with the seal segments and by the alignment of the gap Y with the support segments.

Differences in gas pressure between the upstream and the downstream faces of the support segments urge the upstream support rearwardly. The alternate embodiment in FIG. 7 shows the application of a mechanical force to urge the upstream support segment rearwardly. The dimension A determines the amount of compression of the Belleville spring. The amount of compression of the Belleville spring establishes the perpendicular force urging the support segment against the flange. The diametrical clearance B between the upstream support segment and the end bolt permits circumferential movement of the ends of the upstream support segment 40'.

Although this invention has been shown and described with respect to a preferred embodiment thereof, it should be understood by those skilled in the art that various changes and omissions in the form and detail thereof may be made therein without departing from the spirit and scope of the invention. For example, expansions and contractions of the case may be encouraged by the use of air hotter than the case rather than by air cooler than the case.

Having thus described a typical embodiment of our invention, that which we claim as new and desire to secure by Letters Patent of the United States is:

1. In a gas turbine engine of the type having a segmented outer air seal circumscribing the tips of a row of rotor blades and having a coolable engine case that includes a plurality of external rails extending circumferentially thereabout, the improvement which comprises:

a means for attaching the outer air seal to the engine case which includes, a plurality of arcuate upstream support segments each having a central portion and two end portions and each upstream support segment engaging the upstream end of at least one seal segment, a means for attaching each of the upstream support segments to the engine case which affixes only the central portion of the upstream support segment to the engine case with the end portions being free to move circumferentially with respect to the engine case;

a plurality of arcuate downstream support segments each having a central portion and two end portions and each downstream support segment engaging the downstream end of at least one seal segment; and a means for attaching each of the downstream support segments to the engine case which affixes only the central portion of the downstream support segment to the engine case with the end portions being free to move circumferentially with respect to the engine case.

2. The invention according to claim 1 wherein said engine case further has:

an upstream internal flange that extends circumferentially and engages said means for attaching the upstream support segment to the engine case and that has local portions free of circumferentially continuous material to cause a reduction in the hoop strength of the flange; and a downstream internal flange that extends circumferentially and engages said means for attaching the downstream support segment to the engine case and that has local portions free of circumferentially continuous material to cause a reduction in the hoop strength of the flange.

3. The invention according to claim 2 wherein:

each of said seal segments has an upstream groove and a downstream groove;

said engine case has an upstream groove and a downstream groove;

each of said upstream support segments has an inner tongue that engages the upstream groove of at least one of the seal segments, and an outer tongue that engages the upstream groove of the engine case;

each of said downstream support segments has an inner tongue that engages the downstream groove of at least one of the seal segments and an outer tongue that engages the downstream groove of the engine case;

a shearable material is disposed between the central portion of the upstream support segment and the engine case; and a shearable material is disposed between the central portion of the downstream support segment and the engine case.

4. The invention according to claim 3 wherein:

each of said arcuate upstream support segments is circumferentially spaced one from another leaving a gap therebetween;

each of said arcuate upstream support segments in each of the two end portions further has an inner groove that is substantially axially oriented and an outer groove that is substantially radially oriented;

a first feather seal engages the inner groove in one upstream support segment and extends across the gap between upstream support segments to engage the inner groove in the immediately adjacent upstream support segment;

a second feather seal engages the outer groove in one upstream support segment and extends across the gap between upstream support segments to engage the outer groove in the immediately adjacent upstream support segment;

a second feather seal engages the outer groove in one upstream support segment and extends across the gap between upstream support segments to engage the outer groove in the immediately adjacent upstream support segment;

each of said arcuate downstream support segments is circumferentially spaced one from another leaving a gap therebetween;

each of said arcuate downstream support segments in each of the two end portions further has an inner groove that is substantially axially oriented and an outer groove that is substantially radially oriented;

a third feather seal engages the inner groove in one downstream support segment and, extends across the gap between upstream support segments to engage the inner groove in the immediately adjacent downstream support segment;

a fourth feather seal engages the outer groove in one downstream support segment and, extends across the gap between upstream support segments to engage the outer groove in the immediately adjacent downstream support segment.

5. The invention according to claim 4 wherein:

each of said seal segments further has an indexing slot in the upstream end;

each of said upstream support segments has at least one indexing pin that engages the index slot of one of the seal segments; and the seal segments are circumferentially spaced one from another leaving a gap therebetween and are positioned in the engine such that each gap between adjacent seal segments is circumferentially displaced from each gap between adjacent upstream support segments and each gap between adjacent downstream support segments.

6. A rotary machine having an axially extending flow path with an upstream end and a downstream end, a portion of which comprises:

an engine case having a central axis, an upstream groove and a downstream groove extending circumferentially about the interior thereof, and at least one rail extending outwardly from the case;

a segmented outer air seal including a plurality of arcuate seal segments circumferentially spaced one from another leaving a gap therebetween having an upstream groove and a downstream groove;

an upstream flange which is attached to and extends inwardly from the case, said flange having local portions free of circumferentially continuous material to cause a reduction in the hoop strength of the flange;

a downstream flange which is attached to and extends inwardly from the case, said flange having local portions free of circumferentially continuous material to cause a reduction in the hoop strength of the flange;

a plurality of arcuate upstream support segments which are circumferentially spaced one from another leaving a gap therebetween and which are positioned in the engine such that the gap is circumferentially displaced from the gap between the adjacent arcuate seal segments having, a central portion and two end portions, wherein each end portion has an inner groove that is substantially axially oriented and an outer groove that is substantially radially oriented, an inner tongue that engages the upstream groove of at least one of the seal segments, and an outer tongue that engages the upstream groove in the engine case;

a shearable material disposed between the central portion of the upstream support segment and the engine case;

a first feather seal that engages the inner groove in one upstream support segment and extends across the gap between upstream support segments to engage the inner groove in the immediately adjacent upstream support segment;

a second feather seal that engages the outer groove in one upstream support segment and extends across the gap between upstream support segments to engage the outer groove in the immediately adjacent upstream support segment;

a plurality of arcuate downstream support segments which are circumferentially spaced one from another leaving a gap therebetween and which are positioned in the engine such that the gap is circumferentially displaced from the gap between the adjacent arcuate seal segments having, a central portion and two end portions, wherein each end portion has an inner groove that is substantially axially oriented and an outer groove that is substantially radially oriented, an inner tongue that engages the downstream groove of at least one of the seal segments, and an outer tongue that engages the downstream groove in the engine case;

a shearable material disposed between the central portion of the downstream support segment and the engine case;

a third feather seal that engages the inner groove in one downstream support segment and extends across the gap between downstream support segments to engage the inner groove in the immediately adjacent downstream support segment;

a fourth feather seal that engages the outer groove in one downstream support segment and extends across the gap between downstream support segments to engage the outer groove in the immediately adjacent downstream support segments;

a means for attaching each of the upstream support segments to the upstream flange that affixes only the central portion of the upstream support segment to the upstream flange with the end portions being free to move circumferentially with respect to the engine case;

an array of stator vanes downstream of the outer air seal that extend inwardly in a substantially radial direction from the engine case;

a means for attaching each of the downstream support segments to the downstream flange of the engine case that affixes only the central portion of the downstream support segment to the upstream flange with the end portions being free to move circumferentially with respect to the engine case, and said means engages a downstream vane; and a means for attaching at least one of the downstream vanes to the downstream flange, wherein the means extends axially through the slot in the downstream flange and includes a spacer, the spacer having an axial thickness greater than the adjacent axial thickness of the downstream support segment to enable circumferential movement of the end portion of the downstream support segment.

7. The invention according, in the alternative, to claims 2, 3, 4, 5, 6, or 1 which further includes at least one means for applying a substantially perpendicular force to the upstream support segment, and a retention means that engages the upstream flange and that urges rearwardly the means for applying a substantially perpendicular force into abutting relationship with the upstream support segment.

8. The invention according to claim 7 wherein the means for applying a substantially perpendicular force is an initially coned spring.

9. In a gas turbine engine of the type having a segmented outer air seal of the type supported by an upstream structure and a downstream structure extending inwardly of a coolable outer case, an improved structure for adjusting the diameter of said seal, which comprises:

an upstream support structure having an upstream flange extending inwardly from the outer case having gaps which interrupt the circumferential continuity of the flange to reduce the ability of the upstream flange to resist compressive forces, and an upstream support ring extending between the upstream flange and the outer air seal which is segmented to reduce the ability of the upstream support ring to resist compressive forces; a downstream support structure having a downstream flange extending inwardly from the outer case having gaps which interrupt the circumferential continuity of the flange to reduce the ability of the downstream flange to resist compressive forces, and a downstream support ring extending between the downstream flange and the outer air seal which is segmented to reduce the ability of the downstream support ring to resist compressive forces;

an upstream rail extending circumferentially about the exterior of the case radially outwardly of and in close proximity to the upstream support structure;

a downstream rail extending circumferentially about the exterior of the case radially outwardly of and in close proximity to the downstream support structure; and a means for impinging cooling air on the upstream rail and the downstream rail; wherein the rails are adapted to contract in operative response to the cooling air impinging thereupon to exert a compressive force on the flanges and the support rings thereby causing the diameter of the support rings to decrease and consequently causing the diameter of the outer air seal to decrease.

* * * * *

UNITED STATES PATENT AND TRADEMARK OFFICE

CERTIFICATE OF CORRECTION

PATENT NO. : 4,247,248

DATED : January 27, 1981

INVENTOR(S) : GARY FRANCIS CHAPLIN ET AL

It is certified that error appears in the above—identified patent and that said Letters Patent is hereby corrected as shown below:

Column 3, line 47: after "structure" the word "such" was omitted

Column 4, line 28: after "outer" delete the word "flange"

Column 5, line 45: after "134" the word "passed" should read "passes"

Column 7, lines 27 and 28: "Radially" should read "Radial"

Column 7, line 34: "grow" should read "grows"

Signed and Sealed this

*Twenty-first* Day of *July 1981*

[SEAL]

*Attest:*

GERALD J. MOSSINGHOFF

*Attesting Officer*

*Commissioner of Patents and Trademarks*